US005363015A

United States Patent [19]

Dakin et al.

[11] Patent Number: 5,363,015

[45] Date of Patent: Nov. 8, 1994

[54] LOW MERCURY ARC DISCHARGE LAMP CONTAINING PRASEODYMIUM

[75] Inventors: James T. Dakin, Shaker Heights; Tommie Berry, Jr., East Cleveland; Mark E. Duffy, Shaker Heights; Timothy D. Russell, Cleveland Heights, all of Ohio

[73] Assignee: General Electric Company, Schenectady, N.Y.

[21] Appl. No.: 927,041

[22] Filed: Aug. 10, 1992

[51] Int. Cl.[5] ..... H01J 17/20; H01J 61/12

[52] U.S. Cl. ..... 313/638; 313/641; 313/642; 313/571; 313/161; 315/248; 315/344

[58] Field of Search ..... 313/638, 642, 643, 640, 313/570, 161, 571, 641; 315/248, 344

[56] References Cited

U.S. PATENT DOCUMENTS

| | | | |
|---|---|---|---|
| 3,786,297 | 1/1974 | Zollweg et al. | 313/229 |
| 3,906,274 | 9/1975 | Silver et al. | 313/228 |
| 4,422,011 | 12/1983 | Bruninx-Poesen et al. | 313/642 |
| 4,801,846 | 1/1989 | Kramer et al. | 313/641 |
| 4,810,938 | 3/1989 | Johnson et al. | 315/248 |
| 4,812,702 | 3/1989 | Johnson | 313/153 |
| 4,959,584 | 9/1990 | Anderson | 313/160 |
| 4,972,120 | 11/1990 | Witting | 313/638 |
| 5,039,903 | 8/1991 | Farrall | 313/160 |

*Primary Examiner*—Donald J. Yusko
*Assistant Examiner*—Ashok Patel
*Attorney, Agent, or Firm*—Stanley C. Corwin; Edward M. Corcoran

[57] ABSTRACT

A high intensity electrodeless metal halide arc discharge lamp wherein RF energy is coupled to the arc discharge, contains a halide of praseodymium alone or in combination with other metals such as one or more rare earth metals, Na and Cs and is essentially mercury free (i.e., < 1 mg per cc of arc chamber volume).

27 Claims, 2 Drawing Sheets

LOW MERCURY ARC DISCHARGE LAMP CONTAINING PRASEODYMIUM

BACKGROUND OF THE INVENTION

1. Field of the Invention

This invention relates to a low mercury arc discharge lamp containing a halide of praseodymium. More particularly this invention relates to a high intensity, electrodeless arc discharge lamp wherein the arc tube contains an essentially mercury-free fill including a halide of praseodymium.

2. Background of the Disclosure

High intensity electroded arc discharge lamps such as high pressure sodium lamps and metal halide lamps are well known and include a light-transmissive arc discharge chamber or tube hermetically sealed and enclosing within a pair of spaced apart electrodes and a suitable fill such as an inert starting gas and one or more ionizable metals or metal halides. Two of the major causes of lamp failure are sputtering of electrode material onto the lamp envelope and thermal and electrical stresses which result in electrode failure. More recently a new class of arc discharge lamps has been developed called electrodeless lamps. Such lamps have a light-transmissive, electrodeless arc chamber or tube generally shaped like a pillbox or slightly flattened sphere and containing a fill which comprises a suitable inert buffer gas and one or more metal halides. Radio frequency (RF) energy applied or coupled to the fill via capacitive or inductive coupling generates a light-emitting arc. In operation of such a lamp via inductive coupling, the arc tube or chamber acts as a single-turn secondary coil of a transformer and is surrounded by an RF energy excitation coil which acts as a primary coil. Various embodiments of such lamps are disclosed, for example, in U.S. Pat. Nos. 4,810,938; 4,972,120; 4,959,584 and 5,039,903 all of which are assigned to the assignee of the present invention. Continuing research and development has been directed towards improving the color emitted by electrodeless arc discharge lamps while maintaining the relatively high color rendering index (CRI) and lamp efficacy exhibited by these lamps.

SUMMARY OF THE INVENTION

The present invention relates to an arc discharge lamp, particularly an electrodeless arc discharge lamp, having good color, efficacy and CRI wherein the arc chamber or tube contains an essentially mercury-free fill comprising a buffer gas and at least one halide of praseodymium (Pr). Thus, the present invention relates to an arc discharge lamp and particularly an electrodeless arc discharge lamp comprising a light-transmissive arc chamber containing an arc-sustaining fill which is essentially mercury-free and which comprises at least one halide of Pr, said lamp further including means for applying or coupling electrical energy, such as radio frequency (RF) energy, to said fill to produce a light-emitting arc. It is understood of course that at least a portion of the Pr in the fill will be present in the arc and contribute to the visible light emission spectrum emitted by the arc plasma during operation of the lamp. The fill will also contain a suitable buffer gas.

By essentially mercury-free is meant that if mercury is present in the arc chamber, it will be present in an amount of less than 1 mg per cc of arc chamber volume. By buffer gas is meant a gas which does not adversely effect the operation of the lamp and which acts as a buffer to reduce metal transport from the arc to the wall of the arc chamber. In most embodiments, in addition to containing at least one halide of Pr, the fill will also contain a halide of one or more additional metals such as rare earth metal, cerium (Ce), sodium (Na), cesium (Cs), etc. It should be understood that this list of metals is meant to be illustrative, but not limiting to the practice of the invention.

DETAILED DESCRIPTION

Figure 1:
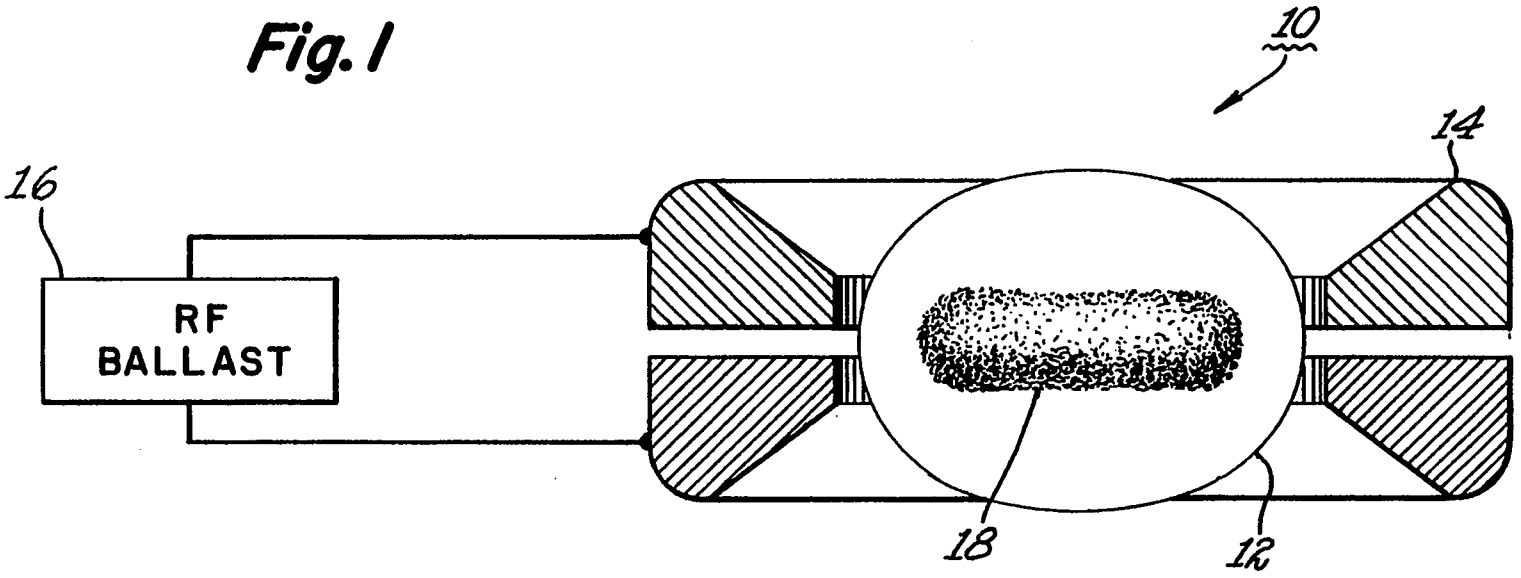
FIG. 1 schematically illustrates an electrodeless arc discharge lamp useful in the practice of the invention.

FIG. 1 schematically illustrates a high-intensity, metal halide electrodeless arc discharge lamp 10 of the present invention which includes an arc chamber 12 in the general shape of a slightly flattened sphere which enables nearly isothermal operation. Other arc chamber shapes such as generally spherical, ellipsoidal, etc., may be used provided that such shape permits the formation of an arc within the arc chamber. Electrical power in the form of an RF signal is applied to the arc chamber by an excitation coil 14 disposed about arc chamber 12 and connected in the embodiment shown to an RF power supply or ballast 16. In this embodiment the RF power is inductively coupled to the arc. By RF in the context of the invention is meant to include microwave frequencies as well as radio frequencies. Excitation coil 14 is illustrated as a two-turn coil having the configuration shown wherein the overall shape of the excitation coil is generally that of a surface formed by rotating a bilaterally symmetrical trapezoid about a coil center line situated in the same plane as the trapezoid, but which line does not intersect the trapezoid. Such a coil configuration results in very high efficiency and causes only minimal blockage of light from the lamp. This particular coil configuration is described in greater detail in U.S. Pat. No. 5,039,903 the disclosures of which are incorporated herein by reference. However, other suitable coil configurations may be used, such as that described in commonly assigned U.S. Pat. No. 4,812,702, the disclosure of which is also incorporated herein by reference. In particular, the '702 patent describes a coil having six turns which are arranged to have a substantially V-shaped cross section on each side of a coil center line. Still another suitable excitation coil may be of solenoidal shape, for example. The choice of coil configuration, location and shape will be determined by the practitioner In operation, RF current in coil 14 results in a time-varying magnetic field which produces within arc tube or chamber 12 an electric field that closes upon itself. Current flows through the fill within chamber 12 as a result of this solenoidal electric field, producing a toroidal arc discharge 18 in chamber 12. The operation of an electrodeless high intensity discharge lamp is described in the Johnson et al U.S. Pat. No. 4,810,938. Suitable operating frequencies for the RF power supply range from 0.1 megahertz to 300 megahertz.

Arc chamber 12 is made of a suitable electrically insulative, light-transmissive material such as fused quartz made from high purity silica sand or natural or synthetic quartz, a high temperature glass or an optically transparent or translucent ceramic such as sapphire or polycrystalline alumina. The material of choice for these arc chambers at the present time is fused quartz having a purity of greater than 99% $SiO_2$.

The arc chamber in lamps of the present invention is essentially mercury-free and has hermetically sealed within it a fill comprising a buffer gas and at least one halide of Pr. As set forth above, by essentially mercury-free is meant that mercury may be present in the arc chamber, but in an amount less than 1 mg per cc of arc chamber volume. Preferably the mercury, if present in the arc chamber, will be present in an amount of less than 0.3 mg per cc and more preferably less than 0.2 mg per cc. This is substantially less than the amount of mercury present in the arc chambers of both electrodeless and electroded arc discharge lamps of the prior art wherein the mercury is present in the arc chamber in amounts of up to 40 mg per cc or more. The presence of mercury in the arc chamber of a lamp of the present invention in amounts greater than that set forth above will reduce the lamp efficacy and affect the color of the light emitted by the arc. In electrodeless lamps it has also been found that the presence of mercury in the arc chamber also increases coil losses, which further reduces lamp efficacy.

As set forth above, the arc chamber must contain at least one halide of Pr and in most embodiments will also contain at least one halide of one or more additional metals which participate in the emission spectrum emitted by the arc plasma of which illustrative, but non-limiting examples include, Na, Cs, Sn, the rare earth metals such as cerium (Ce), neodymium (Nd), dysprosium (Dy), holmium (Ho), thulium (Tm), etc. Sodium and cesium have been found to have a stabilizing effect on the arc discharge. Praseodymium itself provides a relatively high color temperature of about 5500° K. which exhibits a cool color toward the blue-green portion of the visible light spectrum. Sodium exhibits a warmer, lower color temperature more towards the yellow portion of the spectrum and increases efficacy when used with Pr, but is slowly depleted from the arc chamber by diffusion. Cesium doesn't affect the color temperature. Hence, if a halide of Cs is used with the Pr halide and a warmer color temperature is desired, one or more additional metal halides exhibiting a warm color temperature must be employed. In a preferred embodiment an electrodeless lamp of the invention will contain a halide of Pr along with at least one additional metal halide of a metal selected from the group consisting essentially of Cs, Na, Nd and mixtures thereof. The choice of additional metal halide(s) is left to the practitioner depending on the color temperature, efficacy and CRI desired for the lamp. The arc chamber must also be hot enough during operation of the lamp to insure that the Pr and any other metal used in the fill to achieve the desired color and efficacy is a constituent of the arc plasma. In general, this means that the coolest portion of the arc chamber will be over 500° C.

Those skilled in the art know that an arc chamber can be designed to be either dose limited or vapor pressure limited or a combination of dose and vapor pressure limited. In a dose limited arc chamber all of the metal halide present is vaporized during operation of the arc. A vapor pressure limited design requires a portion of each metal halide to be present as condensate during operation of the arc. Thus, in a vapor limited lamp design, each metal halide in the arc chamber will be present in an amount in excess of that required to achieve the desired color and efficacy so that a portion of each metal halide employed will be present as condensate during operation of the lamp.

Preferred halides include iodides, chlorides, bromides and mixtures thereof, with iodides being preferred. Thus, in one embodiment metal iodides are preferred for use in the lamps of this invention. The arc chamber also contains a buffer gas which is inert to the extent that it does not adversely effect operation of the lamp and which acts as a buffer to reduce metal transport from the arc plasma to the arc chamber wall and which also preferably aids in starting the arc. Noble gases are suitable buffer gases. Although any noble gas will work to some extent, preferred gases are krypton (Kr), xenon (Xe), argon (At) and mixtures thereof, with Kr being particularly preferred. Although neon (Ne) could be used, it will slowly diffuse through the quartz wall of the arc chamber which will lower lamp efficacy and it also emits a bluish color when ionized. Helium (He) could also be employed, but is even more prone to diffusing through the wall of a quartz arc chamber. Furthermore, He has a higher thermal conductivity than Ne, At, Kr or Xe and therefore higher thermal conduction loss. The pressure of the gas in the arc chamber will be above 50 torr and more preferably above 100 tort at room temperature.

The invention will be further understood by reference to the examples set forth below.

EXAMPLES

In all of the examples the lamp was as illustrated in FIG. 1 employing a fused quartz arc chamber whose dimensions were 26 mm OD and 19 mm high with a wall thickness of approximately 1 mm. During operation the coldest portion of the arc chamber was about 900° C. In all cases the metal halides were iodides, the arc chamber contained Kr at a pressure of 250 torr at room temperature in addition to the metal iodide and the Pr vapor pressure was sufficiently high during lamp operation for the Pr radiation to contribute more than 10% of the total visible radiation emitted by the arc. None of the arc chambers contained mercury. An RF coil as shown in FIG. 1 operating at 13.56 MHz furnished from 200 to 400 watts of power to the arc. Luminous efficacy and color were measured in an integrating sphere using standard photometric techniques. Finally, in all cases each metal halide in the arc chamber was present in an amount in excess of that required to achieve the desired color and efficacy, which insured that a portion thereof was present as condensate during operation of the lamp.

| Example | Halide Doses A | B | C | Ratios A B C | Wgt mg | Arc lpw | CCX | CCY | CCT K | CRI |
|---|---|---|---|---|---|---|---|---|---|---|
| A | Pr13 | CsI | | 1 1 | 5 | 137 | 0.32 | 0.38 | 5926 | 82 |
| B | Pr13 | CsI | | 1 1 | 5 | 141 | 0.33 | 0.38 | 5414 | 87 |
| C | Pr13 | CsI | | 1 1 | 5 | 132 | 0.33 | 0.38 | 5593 | 88 |
| D | Pr13 | NdI3 | CsI | | | 134 | 0.32 | 0.40 | 5640 | 80 |
| E | Pr13 | NaI | | 1 5 | 8 | 171 | 0.41 | 0.42 | 3524 | 55 |
| F | Pr13 | NaI | | 1 5 | 8 | 168 | 0.42 | 0.42 | 3323 | 50 |
| G | Pr13 | NaI | | 1 5 | 8 | 173 | 0.45 | 0.42 | 2948 | 40 |

Examples A–C

Figure 2:
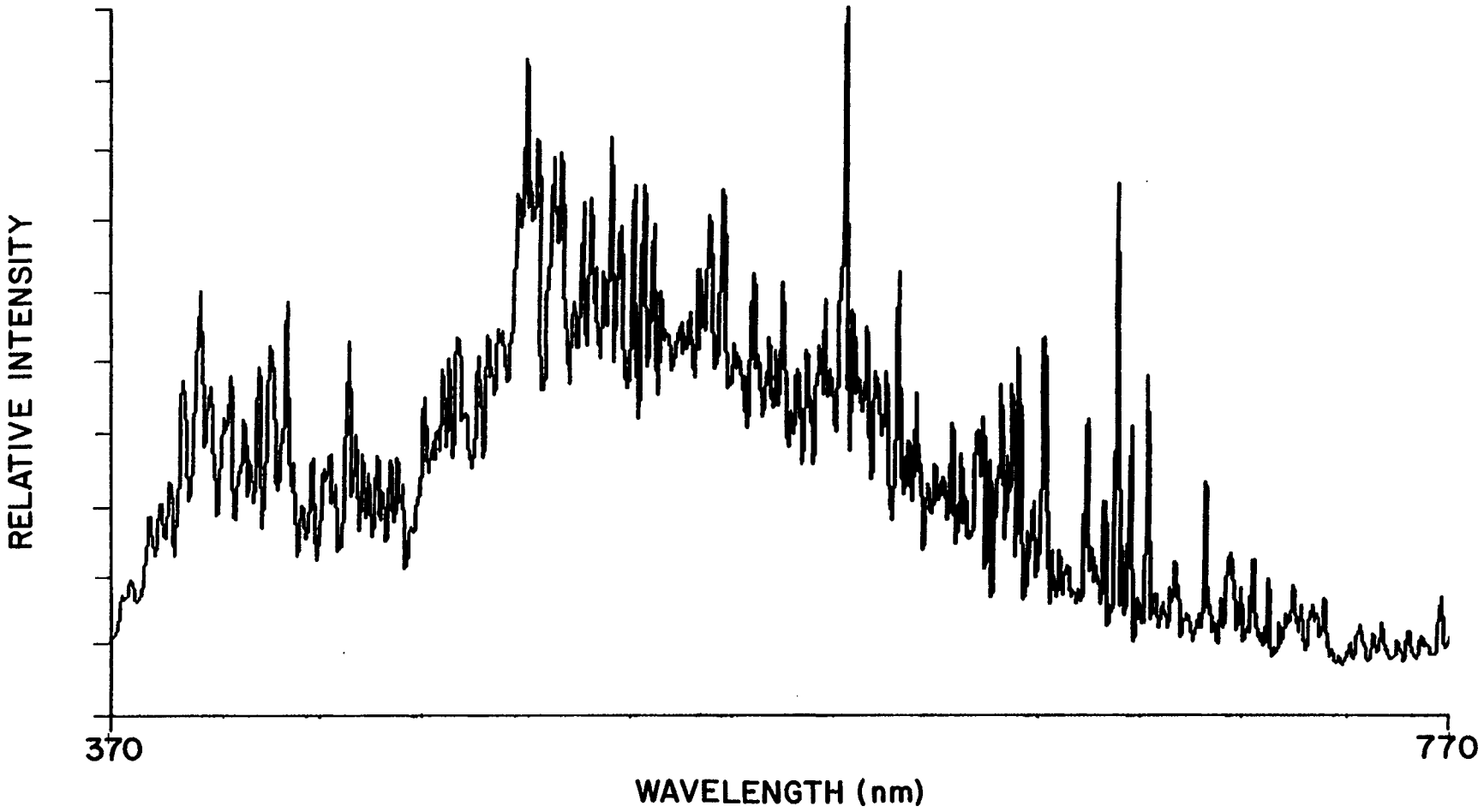
FIG. 2 is an emission spectrum of relative intensity versus wavelength illustrating the visible color spectrum of an electrodeless lamp containing a praseodymium halide according to the invention.

In these three examples the metal halide in the arc chamber was 5 mg of a 1:1 molar mixture of $PrI_3$:CsI and the arc chambers were operated at input power levels of 350 watts. The data show very good CRI and efficacy along with a color a little bit on the cool (green) side. FIG. 2 is an emission spectrum of Example A as relative intensity versus wavelength. The presence of cesium (Cs) in the lamp is primarily for arc stability and does not significantly affect the color. Hence, the emission spectrum shown is essentially that of the praseodymium. The figure shows that the praseodymium emission is full and continuous over the visible light spectrum which accounts for its good color and color rendering properties.

Example D

This example illustrates lamps of the invention containing a ternary mixture of $PrI_3/NdI_3/CsI$. The color temperature and efficacy are similar to the Pr/Cs lamps of examples A–C, but the CRI is a little lower. The CsI helps to stabilize the arc.

Examples E–G

In these examples the arc tubes or chambers operated at 350 watts of input power and contained a high sodium content fill of a mixture of $PrI_3$ and NaI. The data show a very high efficacy with a warm (low color temperature) color, but at a sacrifice in CRI compared to the lamps of Examples A–C and D.

What is claimed is:

1. A light-transmissive arc chamber for an arc discharge lamp containing a fill for initiating and sustaining said arc discharge wherein said fill includes less than 1 mg/cc of arc chamber volume of mercury and comprises a halide of Pr.

2. An arc chamber of claim 1 also containing a buffer gas.

3. An arc chamber of claim 2 wherein said buffer gas comprises at least one noble gas.

4. An arc chamber of claim 3 wherein said buffer gas is selected from the group consisting of Kr, Xe, Ar and mixture thereof.

5. An arc chamber of claim 4 wherein said halide is selected from the group consisting of iodide, bromide, chloride and mixture thereof.

6. An arc chamber of claim 5 additionally containing halide of a metal selected from the group consisting of Na, Ce, Cs and mixture thereof.

7. An arc chamber of claim 5 containing a halide of at least one rare earth metal.

8. An arc chamber of claim 1 wherein mercury is in an amount less than 0.3 mg/cc of arc chamber volume.

9. An arc chamber of claim 1 wherein mercury is in an amount less than 0.2 mg/cc of arc chamber volume.

10. An arc chamber of claim 9 also containing a halide of at least one rare earth metal.

11. A metal halide arc discharge lamp comprising (i) a light-transmissive arc chamber in which is disposed an arc-sustaining fill including less than 1 mg/cc of arc chamber volume of mercury and which comprises a buffer gas and a halide of Pr, and (ii) means for applying electrical energy to said fill to produce a light-emitting arc.

12. A lamp of claim 11 wherein said buffer gas comprises at least one noble gas.

13. A lamp of claim 12 wherein said halide is selected from the group consisting of iodide, bromide, chloride and mixture thereof and said buffer gas is selected from the group consisting of Kr, Xe, Ar and mixture thereof.

14. A lamp of claim 13 wherein said arc chamber also contains a halide of metal selected from the group consisting of Na, Cs, Ce, other rare earth metal and mixture thereof.

15. A lamp of claim 14 wherein said mercury is in an amount of less than 0.3 mg per cc of arc chamber volume and wherein the coldest portion of said arc chamber is greater than 500° C. during operation of said lamp.

16. An electrodeless metal halide arc discharge lamp having a hermetically sealed, vitreous, light-transmissive arc chamber in which is disposed an arc-sustaining fill including less than 1 mg/cc of arc chamber volume of mercury and which comprises a buffer gas and a halide of praseodymium, said arch chamber having its coldest portion at a temperature greater than 500° C. during operation of said lamp and said lamp further including means for applying RF energy to said fill to produce a light-emitting arc.

17. A lamp of claim 16, wherein said buffer gas comprises at least one noble gas.

18. A lamp of claim 17 wherein said halide includes an iodide.

19. A lamp of claim 17 wherein said buffer gas is selected from the group consisting of Kr, Xe, Ar and mixture thereof and wherein said halide is selected from the group consisting of iodide, bromide, chloride and mixture thereof.

20. A lamp of claim 19 wherein said arc chamber also contains a halide of Na, Ce, Cs or mixture thereof.

21. A lamp of claim 20 wherein said arc chamber contains a halide of at least one rare earth metal.

22. A lamp of claim 21 wherein said mercury is in an amount less than 0.3 mg per cc of arc chamber volume.

23. An electrodeless, metal halide arc discharge lamp having a hermetically sealed, light-transmissive fused quartz arc chamber having disposed therein an arc-sustaining fill including less than 1 mg per cc of arc chamber volume of mercury and comprising (i) a buffer gas at a pressure of at least 50 torr selected from the group consisting essentially of Kr, Xe, Ar and mixture thereof and (ii) a halide of Pr, said lamp further including means for applying RF energy to said fill to produce a light-emitting arc.

24. A lamp of claim 23 wherein said halide is selected form the group consisting of an iodide, bromide, chloride and mixture thereof.

25. A lamp of claim 24 wherein the coldest portion of said arc tube is greater than 500° C. during operation of said lamp.

26. A lamp of claim 25 wherein said RF energy is indicatively coupled to said arc.

27. A lamp of claim 25 wherein praseodymium iodide is present in said arc chamber.

* * * * *